US011927066B2

(12) United States Patent
Halvorsen et al.

(10) Patent No.: US 11,927,066 B2
(45) Date of Patent: Mar. 12, 2024

(54) HIGH PRESSURE RISER CONNECTION TO WELLHEAD

(71) Applicant: CONOCOPHILLIPS COMPANY, Houston, TX (US)

(72) Inventors: Eivind Christoffer Eike Halvorsen, Tananger (NO); Leif Arne Kvarme, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 17/214,238

(22) Filed: Mar. 26, 2021

(65) Prior Publication Data

US 2021/0301617 A1 Sep. 30, 2021

Related U.S. Application Data

(60) Provisional application No. 63/002,515, filed on Mar. 31, 2020.

(51) Int. Cl.
*E21B 33/038* (2006.01)
*E21B 33/06* (2006.01)
*E21B 34/02* (2006.01)

(52) U.S. Cl.
CPC ..... *E21B 33/038* (2013.01); *E21B 33/063* (2013.01); *E21B 34/02* (2013.01)

(58) Field of Classification Search
None
See application file for complete search history.

(56) References Cited

U.S. PATENT DOCUMENTS

| | | | | |
|---|---|---|---|---|
| 4,003,428 | A * | 1/1977 | Zehren | E21B 41/0014 166/341 |
| 4,331,203 | A * | 5/1982 | Kiefer | E21B 33/072 166/360 |
| 7,021,402 | B2 * | 4/2006 | Beato | E21B 19/002 166/345 |
| 7,779,917 | B2 * | 8/2010 | Kotrla | E21B 33/076 166/85.4 |
| 9,187,973 | B2 * | 11/2015 | Cain | E21B 33/064 |
| 9,255,446 | B2 * | 2/2016 | Shafer | E21B 43/0122 |
| 10,081,986 | B2 * | 9/2018 | Stewart | E21B 33/035 |
| 2004/0099420 | A1 * | 5/2004 | Kotrla | E21B 33/061 166/368 |
| 2004/0151549 | A1 * | 8/2004 | Roodenburg | E21B 15/003 405/196 |

(Continued)

OTHER PUBLICATIONS

International Search Report and Written Opinion for PCT/US2021/024451 dated Jul. 23, 2021; 9 pgs.

*Primary Examiner* — Matthew Troutman
*Assistant Examiner* — Douglas S Wood
(74) *Attorney, Agent, or Firm* — CONOCOPHILLIPS COMPANY

(57) ABSTRACT

A suspension head (11) is provided for connection between a high pressure riser (8) and a subsea wellhead (9), for use in drilling and completion operations in which a jack-up rig (1) is employed and a blowout preventer (7) is installed on the jack-up rather than on the wellhead. The use of the suspension head (11) offers improved safety and convenience, allowing the riser (8) to be isolated from the wellhead (9) in emergencies or for carrying out certain operations which would otherwise require the installation of a temporary plug.
(FIG. 1)

6 Claims, 2 Drawing Sheets

(56) References Cited

U.S. PATENT DOCUMENTS

| | | | | |
|---|---|---|---|---|
| 2009/0050329 | A1 | 2/2009 | Johnson et al. | |
| 2012/0273213 | A1 | 11/2012 | Blalock et al. | |
| 2012/0318521 | A1 | 12/2012 | Franklin et al. | |
| 2014/0262309 | A1 | 9/2014 | Cain et al. | |
| 2015/0021038 | A1 | 1/2015 | Shafer et al. | |
| 2015/0027717 | A1 | 1/2015 | Ma et al. | |
| 2018/0073320 | A1* | 3/2018 | Holmes | E21B 34/16 |
| 2018/0320331 | A1* | 11/2018 | Kannegaard | E21B 15/02 |
| 2019/0093445 | A1* | 3/2019 | Kulkarni | E21B 47/10 |
| 2019/0360281 | A1* | 11/2019 | Golovinskij | E21B 19/24 |

* cited by examiner

HIGH PRESSURE RISER CONNECTION TO WELLHEAD

CROSS-REFERENCE TO RELATED APPLICATIONS

This application is a non-provisional application which claims benefit under 35 USC § 119(e) to U.S. Provisional Application Ser. No. 63/002,515 filed Mar. 31, 2020 entitled "HIGH PRESSURE RISER CONNECTION TO WELLHEAD," which is incorporated herein in its entirety.

STATEMENT REGARDING FEDERALLY SPONSORED RESEARCH

None.

FIELD OF THE INVENTION

This invention relates to the drilling and completing of subsea hydrocarbon wells with subsea wellheads, using a drilling rig with a topside blow-out preventer (BOP).

BACKGROUND OF THE INVENTION

A jack-up type drilling rig (as opposed to a floating rig) tends to be used in relatively shallow water, e.g. up to about 100 m depth. The conventional arrangement is for an offshore hydrocarbon well to be associated with a platform above sea level; the wellhead (WH) is located on the platform and a riser connects between the subterranean well and the wellhead. This riser passes within the supporting structure (jacket) of the platform and is therefore well protected from accidental impact by surface vessels or debris. Drilling and completion operations are performed by a jack-up rig which comes alongside the platform and extends a cantilever section over the platform. Drilling and completion operations are performed using a rig tower and other equipment, including a blowout preventer (BOP), supported on the cantilever section of the jack-up rig.

More recently, operators are starting to use subsea well templates in place of platforms. In this case, the wellhead and blow out preventer are normally located on the seabed. In theory, a jack-up rig would be used to install a subsea WH and BOP and to perform drilling and completion operations, but most jack-up rigs are in fact not designed to deploy, install and retrieve a subsea BOP which is a very heavy and large piece of equipment. Therefore, a specially adapted jack-up has to be used for this purpose, with associated issues of cost and availability of a specialized jack-up.

For this reason, it can be desirable to perform drilling and completion operations on subsea wellheads with the BOP located on the jack-up since this avoids the need for a specialized jack-up rig. The applicant has found operations with the above configuration to be successful but desires to further enhance safety and efficiency.

The invention therefore aims to provide improved equipment and/or methodology for drilling and/or completion of a subsea well and wellhead using a jack-up rig, when the BOP is located on the jack-up.

BRIEF SUMMARY OF THE DISCLOSURE

The invention more particularly includes a process for drilling or completing a subsea wellbore with subsea wellhead from a jack-up rig, the process comprising: (a) installing a blow-out preventer on the jack-up rig, (b) installing a high pressure riser between the blow-out preventer and the subsea wellhead, and (c) connecting a suspension head assembly between the riser and wellhead, wherein the assembly includes at least one ram or valve for sealing the well. In this way, an emergency cut off may be provided for use in the event that the high-pressure riser is compromised (e.g. because of a collision with a vessel). The ability to seal the well at the wellhead can also be convenient for other operations which would otherwise require a temporary plug to be installed, which is expensive in rig time.

Thus, the ram or valve may be used to close in the wellbore, or the ram or valve may close and seal around tubing or casing in the well. The ram or valve may be a shear and seal ram and wherein the process includes actuating the ram in the event of an emergency to shear drill pipe passing through the assembly and make a seal.

With the ram or valve closed, the riser may be removed in order to install subsea equipment.

The suspension head may be installed by the jack-up rig, since it has lower mass than a BOP. The suspension head may have a mass of between 10,000 and 100,000 kg, optionally between 20,000 and 60,000 kg, and may be installed over the side of the jack-up using an offshore rig crane on the rig.

The invention also provides a suspension head assembly for drilling or completing a well, the assembly comprising: (a) a first connector for connecting the assembly to a wellhead; (b) a second connector for connecting the assembly to a riser; (c) at least one ram or valve for sealing a well when the assembly is connected to a wellhead. The ram or valve may be suitable for closing and sealing around tubing or casing, or it may be a shear and seal ram (SSR) for use in an emergency. Both types of ram may be provided, e.g. in a double ram block. The second connector may include a re-entry hub.

The second connector may take the form of a re-entry hub of the same type (profile and shape) as the wellhead. The high-pressure riser is deployed with a connector installed on it, which can connect into the re-entry hub of the suspension head in the same way it would connect with the re-entry hub of the wellhead.

The invention also provides a system for drilling or completing a subsea wellbore, the system comprising a jack-up rig having a BOP installed on it, a riser, a subsea wellhead and apparatus as described above.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or"

refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
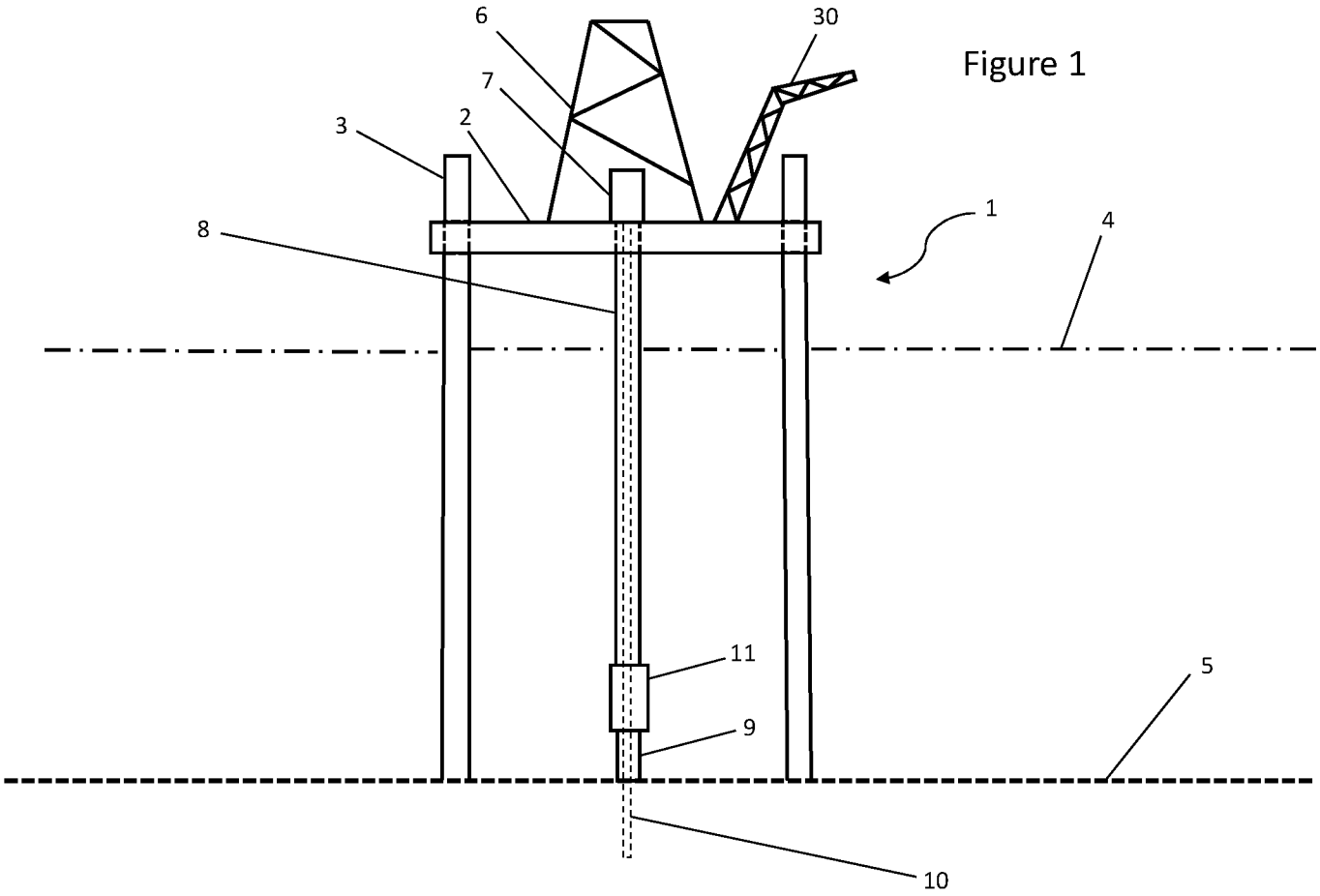
FIG. 1 is a schematic representation of a jack up rig and high-pressure riser with subsea suspension head in accordance with the invention.

As shown in FIG. 1, a jack-up type drilling rig 1 comprises a platform 2 supported by legs 3 which pass through the sea surface 4 and rest on the seafloor 5. A drilling rig tower 6 is located on the platform 2. All of this is conventional.

Unusually for drilling and completion of a subsea well/wellhead, a blowout preventer 7 is located on the platform 2, for the reasons explained above. Because the blow out preventer, or BOP, is located on the platform of the drilling rig rather than being mounted on the wellhead, a high-pressure riser 8 is required to connect the BOP 7 to the wellhead 9. Depending on the operation being performed, tubing or casing or drill string, or combinations of those, represented by reference numeral 10 in FIG. 1, passes down into the well through the wellhead 9.

A suspension head 11 in accordance with the invention is mounted on the wellhead 9 and the high-pressure riser connected to the top of the suspension head 11.

The conventional arrangement for a subsea wellhead, as stated above, is to have the BOP mounted directly onto the wellhead. A conventional marine riser then connects the BOP to the drilling platform. The BOP is controlled from the drilling rig, and includes the normal safety features allowing the well to be closed in the event of an emergency, e.g. due to the pressure from the formation unexpectedly or suddenly increasing. Because the BOP is located on the wellhead, the pressure in the riser need not be high.

Figure 2:
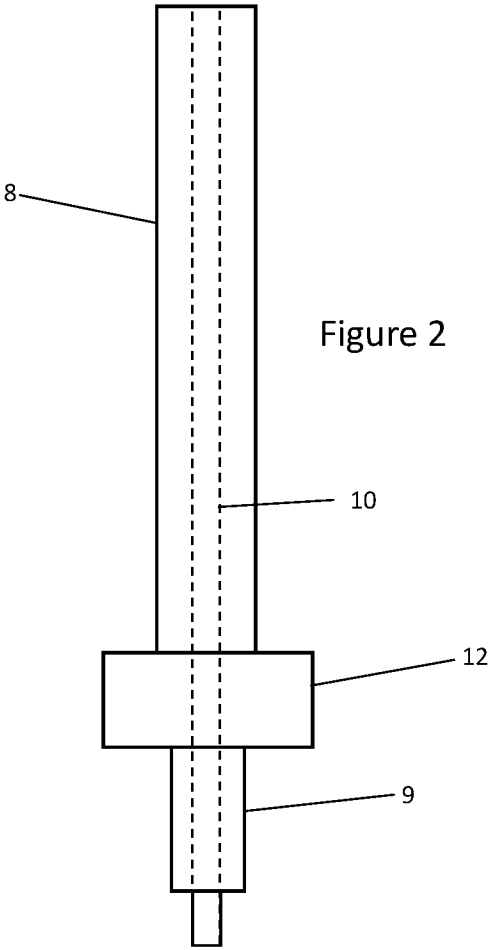
FIG. 2 is a schematic representation of a known type of subsea assembly comprising a subsea wellhead and high-pressure riser.

In the arrangement with the BOP on the jack-up drilling rig, the normal arrangement on the seafloor is shown schematically in FIG. 2. The high-pressure riser 8 is connected to the wellhead 9 via a riser connector 12. Casing, tubing, drill string or a combination of these, is shown at 10. Although this arrangement works well and avoids the need to use a specialized jack-up rig, there are some concerns as set out below.

In the arrangement shown in FIG. 2, the BOP on the rig provides the same safety functions which are normally performed by a subsurface BOP. However, in this arrangement, the riser 8 is exposed to high pressures from the formation. The use of this high-pressure riser represents a potential increased risk because the riser passes through the surface 4 of the sea (the splash zone) and therefore is exposed to potential risks from collisions with surface vessels, foreign objects (e.g. a barge), or from extreme weather conditions.

Figure 3:
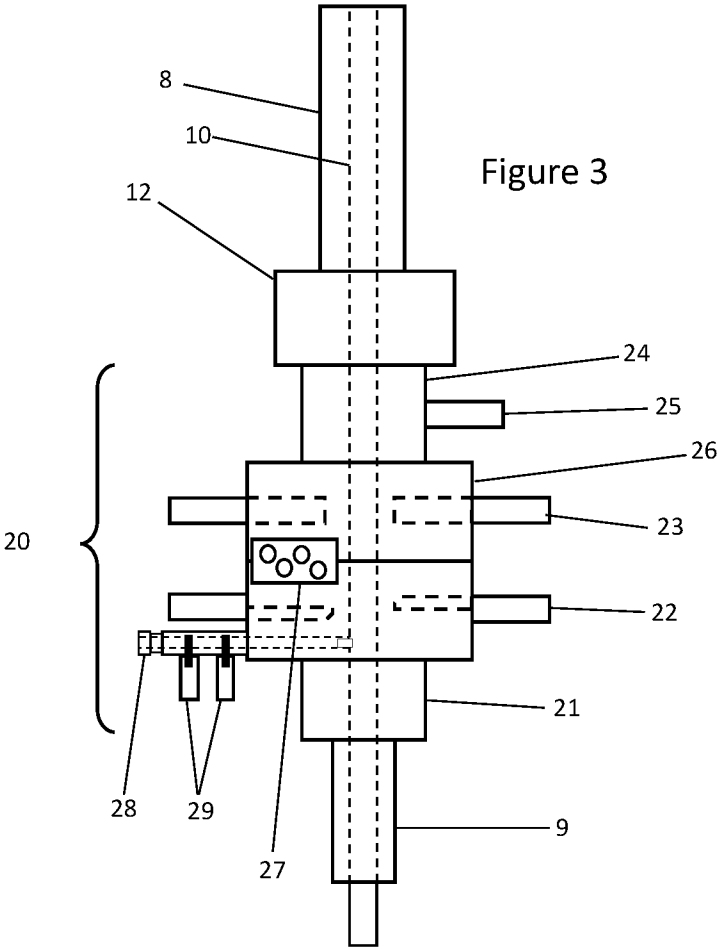
FIG. 3 is a schematic representation of a subsea assembly including a suspension head in accordance with the invention.

FIG. 3 shows in schematic form a subsea installation in accordance with the invention. The wellhead 9, tubing, etc., 10 and high-pressure riser 8 are shown, with the high-pressure riser 8 connected into the assembly via a riser connector 12. However, a suspension head assembly 20 is provided between the riser connector 12 and wellhead 9.

The suspension head assembly 20 comprises a heavy duty H4-profile connector 21 connected to the wellhead 9, a re-entry hub 24 connected to the riser connector 12, and a double ram block 26. The re-entry hub 24 includes a TH orientation pin 25. The functions of all these components, each of which is in itself a well-known piece of equipment, will be explained below.

The double ram block 26 comprises a shear/seal ram (or SSR) 22 which is designed, when actuated, to cut through drill pipe passing through the block 26 and then form a seal.

The shear/seal ram 22 is obviously for use in emergencies, e.g. if formation pressure cannot be contained by the normal means and presents a danger. The block 26 also contains a casing ram 23 which is designed to seal around 10¾" casing.

A side inlet 28 is provided below the SSR 22, which communicates with the well. Side inlet fail safe close valves 29 control the opening or closing of the side inlet. By closing the casing ram 23 and opening side inlet valves 29 below the SSR, fluid may be delivered to the well by an alternative route. This facilitates a more efficient installation and testing of the completion string. In addition, this allows the use of the tubing hanger running tool secondary release function. In the absence of the suspension head, a temporary plug would have to be installed requiring a day or more's rig time, with associated expense.

The re-entry hub 24 and orientation pin 25 are used when a tubing hanger is to be landed on the wellhead; the pin 25 is manipulated by an ROV to rotate the Tubing Hanger into the correct orientation.

The suspension head 20 also includes a control panel 27 for actuating the rams 22, 23 and connectors, and for actuating failsafe close valves 29 for the side inlet 28. The controls on control panel 27 may be actuated by a remotely operated subsea vehicle (not shown).

The suspension head assembly comprises some of the components normally found in a BOP (e.g. the rams), but is a considerably smaller and lighter piece of equipment than a BOP. A BOP includes, for example, several ram configurations, control pods, and an accumulator bank for enhancing the delivery of hydraulic power. Together all this sums up to the majority of the mass of a BOP. A BOP may have a mass of between 200 and 400 metric tonnes (200,000 to 400,000 kg) whereas a suspension head in accordance with the invention may have a mass of about 40 metric tonnes (40,000 kg), and may be installed over the side of the jack-up using an offshore rig crane 30 on the rig. For this reason, a standard jack-up rig will normally have the lifting capacity to install a suspension head according to the invention, whilst the standard jack-up would be unable to install a BOP.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for drilling and completing a subsea wellbore from a jack-up rig in water of depth about 100 meters or less, wherein the subsea wellbore is connected to and communicates with a subsea wellhead, the process comprising:

a) installing a blow-out preventer on the jack-up rig, wherein the blow-out preventer includes a plurality of ram configurations, control pods, and an accumulator bank;

b) installing a riser between said blow-out preventer and said subsea wellhead in water up to 100 m depth, whereby said blow-out preventer communicates with said subsea wellbore; and c) connecting via an offshore rig crane a lower mass subsea suspension head assembly between said riser and said subsea wellhead, wherein said subsea suspension head assembly consists of a first connector for connecting the suspension head assembly to a wellhead, a reentry hub, a control panel for actuating the rams and connectors, a double ram or valve block for sealing the well, including casing ram and a shear seal ram, and a second connector for connecting the suspension head assembly to a riser, wherein said suspension head assembly has a mass of between 20,000 and 60,000 kg and is installed over the side of the jack-up;

d) installing and testing a completion string without installation of a temporary plug, wherein a side inlet and side inlet fail safe close valves are provided in the suspension head assembly below the shear seal ram, the step of installing and testing the completion string including closing the casing ram and opening the side inlet valves to deliver fluid to the well.

2. A process as claimed in claim 1 comprising closing in the wellbore by actuating the ram or valve.

3. A process as claimed in claim 2 wherein the ram or valve closes and seals around tubing or casing in the well.

4. A process as claimed in claim 2 wherein the said ram or valve is a shear and seal ram and wherein the process includes actuating the ram in the event of an emergency to shear drill pipe passing through the assembly and make a seal.

5. A process as claimed in claim 3 wherein, whilst the ram or valve is closed, the riser is removed in order to install subsea equipment.

6. A process as claimed in claim 1 wherein the suspension head assembly is installed on the wellhead by the jack-up rig.

* * * * *